US008061556B2

(12) United States Patent
Sands et al.

(10) Patent No.: US 8,061,556 B2
(45) Date of Patent: Nov. 22, 2011

(54) AUTOMATED FREEZER COMPONENT

(75) Inventors: Jeffrey L. Sands, Freeport, IL (US); Ronald J. Glavan, Rockton, IL (US); Andrew Paul Franklin, Beloit, WI (US); Randy L. Ginner, Beloit, WI (US); Henry Thomas Ewald, Roselle, IL (US)

(73) Assignee: Restaurant Technology, Inc., Oak Brook, IL (US)

( * ) Notice: Subject to any disclaimer, the term of this patent is extended or adjusted under 35 U.S.C. 154(b) by 933 days.

(21) Appl. No.: 10/725,954

(22) Filed: Dec. 2, 2003

(65) Prior Publication Data

US 2005/0115981 A1 Jun. 2, 2005

(51) Int. Cl.

| | |
|---|---|
| ***F25D 25/04*** | (2006.01) |
| ***G07F 11/14*** | (2006.01) |
| ***G07F 11/00*** | (2006.01) |
| ***B65H 1/00*** | (2006.01) |

(52) U.S. Cl. ..... 221/150 R; 221/198; 221/226; 221/224; 221/23; 221/287; 221/307; 221/310; 221/17; 221/6; 221/11; 221/298; 221/197; 221/297; 221/13; 221/21; 221/124; 99/341; 99/342; 99/357; 99/403; 62/378; 62/381; 62/382; 206/328

(58) Field of Classification Search ..... 221/150 R, 221/198, 226, 224, 23, 287, 307, 310, 251, 221/17, 6, 11, 298, 197, 297, 13, 21, 124; 99/341, 342, 357, 403; 62/378, 381, 382; 206/328

See application file for complete search history.

(56) References Cited

U.S. PATENT DOCUMENTS

| | | | | | |
|---|---|---|---|---|---|
| 2,315,827 | A | * | 4/1943 | Tansley | 221/304 |
| 2,397,403 | A | * | 3/1946 | Bishop | 221/150 R |
| 2,499,089 | A | * | 2/1950 | Brill et al. | 62/251 |
| 3,097,899 | A | * | 7/1963 | Dean et al. | 312/36 |
| 3,998,238 | A | * | 12/1976 | Nigro | 221/279 |
| 4,142,863 | A | * | 3/1979 | Covington et al. | 422/63 |
| RE30,596 | E | * | 4/1981 | Cuelenaere et al. | 313/541 |
| 4,359,157 | A | * | 11/1982 | Horstmann | 206/718 |
| 4,415,092 | A | * | 11/1983 | Boyer | 211/69.1 |

(Continued)

FOREIGN PATENT DOCUMENTS

JP 63-179586 11/1988

(Continued)

OTHER PUBLICATIONS

International Search Report dated Jul. 31, 2006.

(Continued)

*Primary Examiner* — Gene O. Crawford
*Assistant Examiner* — Rakesh Kumar
(74) *Attorney, Agent, or Firm* — Ryndak & Suri LLP

(57) ABSTRACT

An automated freezer stores food items stacked in a removable cartridge. The food items are dispensed from the automated freezer in response to a request for the food items. The food items are loaded into the cartridge outside of the automated freezer. When the cartridge is inserted into the automated freezer, the upper end of the cartridge is inserted into a buffer, pushing a plurality of arms in the buffer upwardly to allow food items to pass through the buffer. When the cartridge is removed from the freezer for reloading of food items, a resilient member biases the arms downwardly to retain any food items in the buffer and to prevent any food items in the buffer from falling.

19 Claims, 2 Drawing Sheets

U.S. PATENT DOCUMENTS

| | | | | | |
|---|---|---|---|---|---|
| 4,484,694 | A | * | 11/1984 | Reuteman et al. | 221/197 |
| 4,592,485 | A | * | 6/1986 | Anderson et al. | 221/150 HC |
| 4,817,818 | A | * | 4/1989 | Lockhart | 221/1 |
| 4,951,837 | A | * | 8/1990 | Lentsch | 221/45 |
| 5,006,329 | A | * | 4/1991 | Lieberman et al. | 424/1.77 |
| 5,105,979 | A | * | 4/1992 | Bakx et al. | 221/150 HC |
| 5,167,345 | A | * | 12/1992 | Bleeker | 221/17 |
| 5,230,440 | A | * | 7/1993 | Kurokawa | 221/7 |
| 5,328,052 | A | * | 7/1994 | Kizilos | 221/42 |
| 5,335,816 | A | * | 8/1994 | Kaufman et al. | 221/13 |
| 5,555,965 | A | * | 9/1996 | Mishina | 194/217 |
| 5,605,249 | A | * | 2/1997 | Gonyea | 221/6 |
| 5,813,569 | A | * | 9/1998 | Cihanek | 221/150 R |
| 5,842,598 | A | * | 12/1998 | Tsuchida | 221/258 |
| 5,997,924 | A | * | 12/1999 | Olander et al. | 426/296 |
| 6,098,836 | A | * | 8/2000 | Gottselig | 221/45 |
| 6,131,399 | A | | 10/2000 | Hall | |
| 6,378,324 | B1 | * | 4/2002 | Percy et al. | 62/448 |
| 6,382,387 | B1 | * | 5/2002 | Morad et al. | 194/351 |
| 6,394,306 | B1 | * | 5/2002 | Pawlo et al. | 221/2 |
| 6,435,370 | B1 | * | 8/2002 | Wilson | 221/251 |
| 6,474,503 | B2 | * | 11/2002 | Davis | 221/223 |
| 6,751,977 | B2 | * | 6/2004 | Sands et al. | 62/378 |
| 6,971,546 | B2 | * | 12/2005 | Costa | 221/297 |

FOREIGN PATENT DOCUMENTS

| | | |
|---|---|---|
| JP | 2-084983 | 7/1990 |
| JP | 2005-523223 | 8/2005 |
| WO | WO 2005/057101 A2 | 6/2005 |

OTHER PUBLICATIONS

Letter from Shiga Patent Office dated Aug. 1, 2008 forwarding Japanese Patent Office Action dated Jun. 3, 2008.

Japanese Patent Office Action dated Jun. 3, 2008.

* cited by examiner

AUTOMATED FREEZER COMPONENT

BACKGROUND OF THE INVENTION

The present invention relates generally to an automated freezer which stores frozen food in a cartridge and automatically removes the frozen food from the cartridge of the freezer component in response to a request for the food.

Freezers are used to keep objects frozen, such as food. Freezers are commonly used in residences, grocery stores, and restaurants. In the restaurant or food service industry, food is often stored in a freezer prior to preparation and serving. The food is usually manually placed into the freezer by an employee. When the food is to be prepared and served, the food is manually removed by an employee. A drawback to the prior art freezers is that additional manual labor is needed to remove the food from the freezer.

In one prior automated freezer, the food is manually stacked on a platform in the freezer compartment. When a request for the food is received, the platform is raised and a removal device removes the food from the automated freezer.

A drawback to this prior automated freezer is that the food is manually stacked in the automated freezer, and the freezer door is therefore open during stacking, allowing cool air to escape. It would be beneficial to use an automated freezer that employs a cartridge that is loaded with the food outside of the automated freezer.

SUMMARY OF THE INVENTION

The automated freezer of the present invention freezes food items stacked in a removable cartridge. The upper end of the cartridge is received in a buffer that retains the food items in the buffer when the cartridge is removed from the automated freezer.

The cartridge includes a first portion and a second portion both including a half-circular bottom portion having a half-circular cutout. Food items are stacked and loaded in one of the portions. The other portion is then attached to the loaded portion to retain the food items in the cartridge. When the cartridge is assembled, the half-circular cutouts form a circular cutout. The loaded cartridge is positioned in the automated freezer by receiving the upper end of the cartridge in an inner passage of the buffer.

When a request for a food item is received, a platform rises and passes through the circular cutout. As the platform rises, the food items raise upwardly and pass through the inner passage of the buffer. When a sensor senses that a food item is proximate to an opening in the automated freezer, a removal device pushes the food item out of the automated freezer.

The buffer includes a plurality of arms moveable between a first position in which the arms enter the inner passage of the buffer and a second position substantially perpendicular to the first position in which the arms do not enter the inner passage of the buffer. The arms are biased in the first position by a resilient member. When the cartridge is loaded in the automated freezer and the food items are lifted, the food items push the arms into the second position, allowing the food items to pass through the inner passage of the buffer.

When the cartridge is removed from the automated freezer for reloading, the resilient members bias the plurality of arms into the first position, retaining any food items in the buffer and preventing them from falling out of the buffer. When the cartridge is reloaded in the automated freezer, the upper end is again inserted into the buffer. When the food items lift, the food items push the arms into the second position to allow passage of the food items through the buffer.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
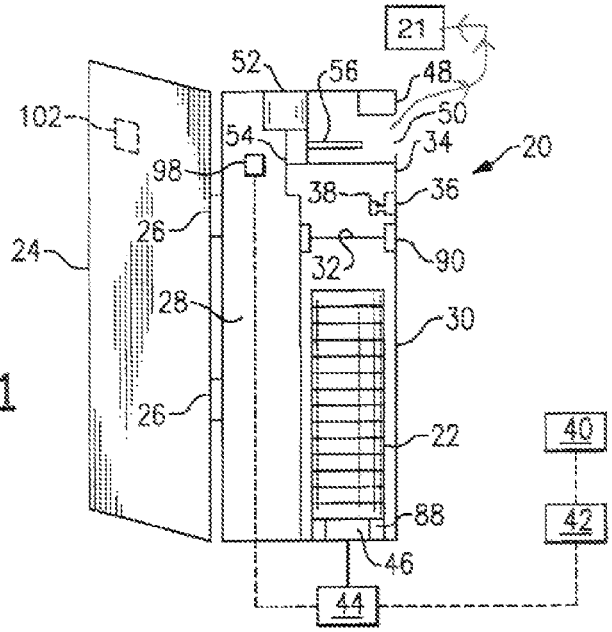
FIG. 1 schematically illustrates a side view of the automated freezer of the present invention.

FIG. 1 schematically illustrates the automated freezer 20 of the present invention. The automated freezer 20 stores and freezes food items 22. In one example, the food items 22 are hamburger patties. The automated freezer 20 can use forced air convection or can be a cold wall freezer. Preferably, the temperature in the automated freezer 20 is between −18° C. and −21° C.

A door 24 is pivotally attached to the automated freezer 20 with hinges 26. The door 24 is pivoted to an open position to allow access to a freezer compartment 28 inside the automated freezer 20 (as shown in FIG. 1) and is pivoted to a closed position to prevent access to the freezer compartment 28.

The food items 22 are stacked in a cartridge 30 loaded in the automated freezer 20. When the cartridge 30 is loaded in the freezer compartment 28, the upper end 32 of the cartridge 30 is inserted into an opening 100 in a buffer 34. When the cartridge 30 is removed from the automated freezer 20, the buffer 34 retains any food items 22 remaining in the buffer 34 and prevents them from falling.

The buffer 34 is removably attached to the automated freezer 20. The automated freezer 20 includes a projection 36 sized and shaped to fit into a hole 38 in the buffer 34. When the buffer 34 is attached to the automated freezer 20, the buffer 34 is slid such that the projection 36 is received in the hole 38, securing the buffer 34 to the automated freezer 20. The buffer 34 can be removed from the automated freezer 20 by sliding the buffer 34 in the opposite direction to remove the projection 36 from the hole 38. However, it is to be understood that the automated freezer 20 can include the hole 38 and the buffer 34 can include the projection 36.

When a food item 22 is to be removed from the automated freezer 20, an input 40 sends a signal to a control 42. The control 42 sends a signal to a motor 44, raising a platform 46 under the food items 22. The food items 22 move upwardly through the cartridge 30 and through the buffer 34. When a sensor 48 senses the food item 22 is proximate to an opening 50 in the automated freezer 20, a motor 52 pivots an arm 56 about a pivot 54 to slide the foot item 22 out of the opening 50. The arm 56 then returns to the rest position. In one example, the food item 22 exiting the automated freezer 20 enters an automated grill 21 for cooking the food item 22.

When a signal is received, a food item 22 is removed from the automated freezer 20. The platform 46 again rises to position another food item 22 proximate to the opening 50 for removal from the automated freezer 20. A subsequent signal removes the next food item 22, and so on.

Preferably, the input 40 includes a POS (point of service) register. When a food item 22 is ordered by a customer, an operator inputs the order into the POS register. The POS register sends the signal to the control 42, which responsively dispenses the desired number of food items 22 from the automated freezer 20. Alternatively, an operator inputs into the input 40 the numbers of food items 22 that are to be dispensed from the automated freezer 20 through the opening 50.

The automated freezer 20 further includes a sensor 98 that detects when the platform 46 reaches a predetermined location in the automated freezer 20. When the platform 46 reaches the predetermined location, the automated freezer 20 and the cartridge 30 need to be reloaded with food items 22. When the sensor 98 detects the platform 46, the motor 44 automatically lowers the platform 46. A visual indicator 102 on the door 24 indicates that the automated freezer 20 and the cartridge 30 must be reloaded with food items 22 to alert an operator to load additional food items 22.

Figure 2:
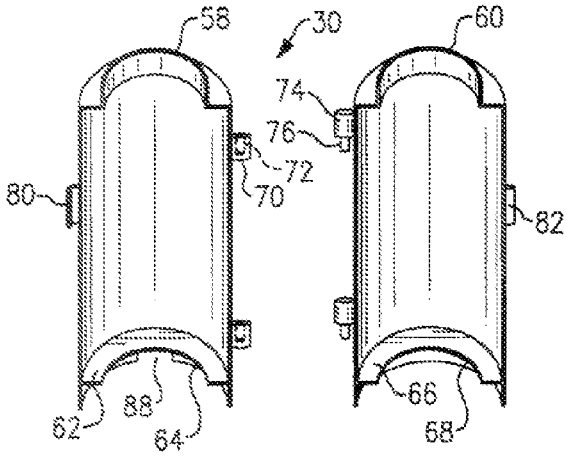
FIG. 2 schematically illustrates a perspective view of an unassembled cartridge.
Figure 3:
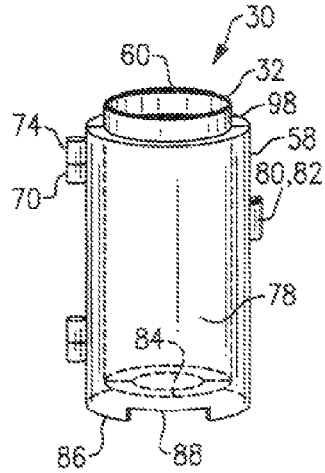
FIG. 3 schematically illustrates a perspective view of an assembled cartridge.

The food items 22 are loaded in the cartridge 30 prior to loading the cartridge 30 in the automated freezer 20. As shown in FIGS. 2 and 3, the cartridge 30 includes a first portion 58 and a second portion 60. The first portion 58 includes a half-circular bottom portion 62 having a half-circular cutout 64, and the second portion 60 includes a half-circular bottom portion 66 having a half-circular cutout 68. The first portion 58 also includes an attachment feature 70 having a hole 72, and the second portion 60 includes an attachment feature 74 having a protrusion 76 sized and shaped to fit in the hole 72. Preferably, the cartridge 30 includes two of each attachment features 70, 74. However it is to be understood that any number of attachment features 70, 74 can be employed. Also, it is to be understood that the first portion 58 can include the attachment feature 74 and the second portion 60 can include the attachment feature 70.

Alternately, the food items 22 are loaded into the cartridge 30 by a manufacturer when the food items 22 are produced. In this example, the cartridge 30 would be shipped to the user of the automated freezer 20 with the food items 22 already stacked. After the cartridge 30 is empty, the cartridge would be disposed of.

When food items 22 are loaded into the cartridge 30, the food items 22 are stacked onto the bottom portion 62, 66 of one of the portions 58, 60, respectively, of the cartridge 30. The other portion 58, 60 is then attached to the portion 58, 60 loaded with food items 22, retaining the food items 22 in the cartridge 30. When attaching the portions 58, 60, the protrusion 76 of the attachment feature 74 is received in the hole 72 of the attachment feature 70. The first portion 58 and the second portion 60 are then pivoted relative to each other to encase the food items 22 in a cylindrical passage 78 defined by the portions 58, 60, as shown in FIG. 3.

An attachment feature 80 on the first portion 58 engages an attachment feature 82 on the second portion 60 to secure the first portion 58 to the second portion 60. When the cartridge 30 is closed, the half-circular cutouts 64, 68 form a circular cutout 84 located above the bottom edge 86 of the cartridge 30. The cartridge 30 further includes a cutout 88 along the bottom edge 86.

When the loaded cartridge 30 is positioned in the freezer compartment 28 of the automated freezer 20, the upper end 32 is first inserted into the opening 100 of the buffer 34. The upper end 32 of the cartridge 30 has an outer diameter less than the inner diameter of the opening 100 in the bottom of the buffer 34. The cartridge 30 is pushed slightly upwardly into the buffer 34 to then allow the bottom edge 86 to enter the freezer compartment 28. When the bottom edge 86 enters the freezer compartment 28, the platform 46 passes through the cutout 88 in the cartridge 30 to allow the bottom edge 86 of the cartridge 30 to enter the freezer compartment 28.

Once the cartridge 30 is positioned in the automated freezer 20, the circular cutout 84 is aligned with the platform 46. When the platform 46 rises in response to a request for a food item 22, the platform 46 passes upwardly through the cutout 88 and into the cartridge 30. The diameter of the cutout 88 is greater than the diameter of the platform 46 to allow the platform 46 to pass through the cutout 88, but smaller than the diameter of the food items 22 to retain the food items 22 in the cartridge 30.

Figure 4A:
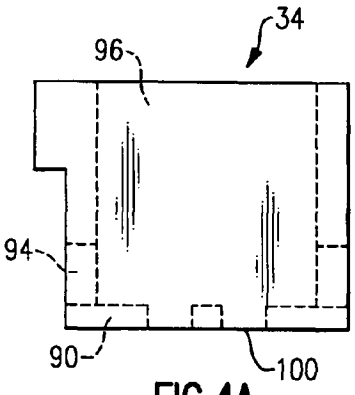
FIG. 4A schematically illustrates a side view of the buffer before the cartridge is inserted into the buffer and a food item is received in the buffer.
Figure 4B:
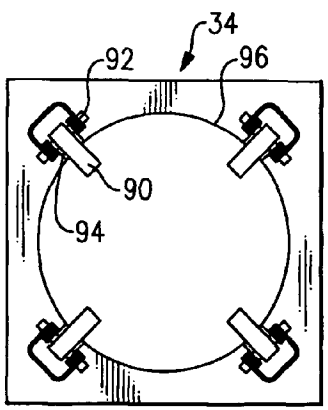
FIG. 4B schematically illustrates a bottom view of the buffer before the cartridge is inserted into the buffer and a food item is received in the buffer.

When the cartridge 30 is removed from the automated freezer 20 to reload the food items 22, a plurality of arms 90 in the buffer 34 retain any food items 22 remaining in the buffer 34 and prevent them from falling from the buffer 34. FIGS. 4A and 4B illustrate the buffer 34 before the cartridge 30 is loaded into the automated freezer 20. The plurality of arms 90 are in a first position and extend into an inner passage 96 of the buffer 34. The plurality of arms 90 are moveable between the first position (shown in FIGS. 4A and 4B) and a second position (shown in FIGS. 5A and 5B) substantially perpendicular to the first position. The arms 90 are biased to the first position by a resilient member 92. Preferably, there are four arms 90. However, it is to be understood that any number of arms 90 can be employed.

Figure 5A:
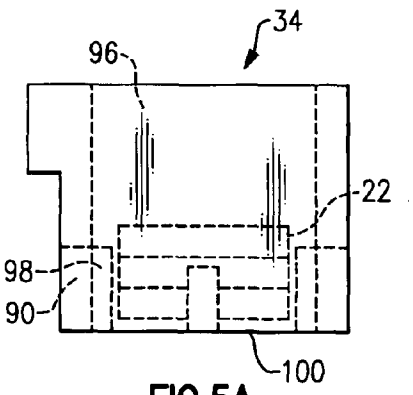
FIG. 5A schematically illustrates a side view of the buffer when the food items are received in the buffer.
Figure 5B:
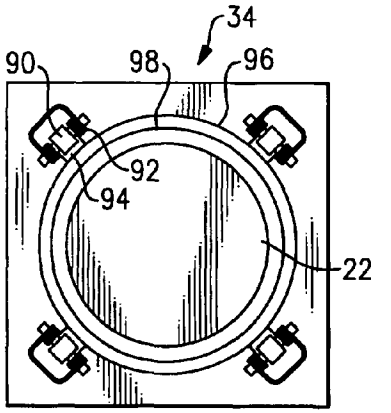
FIG. 5B schematically illustrates a bottom view of the buffer when the food items are received in the buffer.

As shown in FIGS. 5A and 5B, when the cartridge 30 is loaded into the automated freezer 20, the upper end 32 of the cartridge 30 is inserted into the opening 100 of the buffer 34. As the food items 22 move upwardly, the contact of the food items 22 push the arms 90 upwardly into slots 94 in the buffer 34 and into the second position. In the second position, the food items 22 can travel through the inner passage 96 of the buffer 34.

Figure 6A:
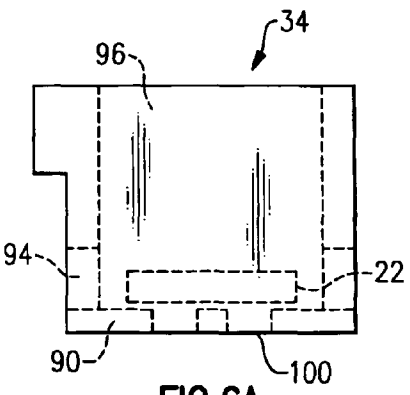
FIG. 6A schematically illustrates a side view of the buffer after the cartridge is removed from the freezer to retain a food item.
Figure 6B:
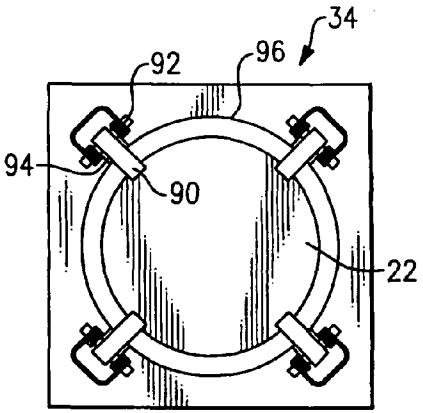
FIG. 6B schematically illustrates a bottom view of the buffer after the cartridge is removed from the freezer to retain a food item.

As shown in FIGS. 6A and 6B, the cartridge 30 is removed from the freezer compartment 28 when the cartridge 30 needs to be refilled with food items 22. The resilient member 92 biases the arms 90 into the first position and into the inner passage 96, retaining any food items 22 remaining in the buffer 34 and preventing the food items 22 from falling from the buffer 34 and into the bottom of the freezer compartment 28. When a cartridge 30 loaded with food items 22 is reinstalled in the automated freezer 20, the upwardly moving food items 22 push the arms 90 upwardly into the second position, allowing the food items 22 to once again enter the buffer 34.

Alternately, the buffer 34 does not include arms 90. In this example, any food items 22 that remained in the buffer 34 would fall out of the buffer 34 when the cartridge 30 is removed from the freezer compartment 28. The food items 22 could then be added to the cartridge 30 when it is reloaded with additional food items 22.

The automated freezer 20 of the present invention can be used with an automated grill, such as described in co-pending patent application Ser. No. 10/124,629 entitled "Automated grill" filed on Apr. 17, 2002. The automated freezer 20 can also be used with a vertical grill, such as described in co-pending patent application Ser. No. 10/726,017 entitled "Grilling Component" filed on Dec. 2, 2003.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. An automated freezer comprising:

a freezer compartment for storing food therein contained in a removable cartridge;

a removable cartridge located in the freezer compartment for storing at least one item;

a platform moveable within said removable cartridge in response to a request for said at least one item;

a retention mechanism to retain at least a portion of said at least one item in the automated freezer when said cartridge is removed from the automated freezer, wherein said retention mechanism is a plurality of arms moveable between a first position and a second position, and said plurality of arms enter said inner passage when in said first position and said plurality of arms do not enter said inner passage when in said second position; and a buffer defining an inner passage, said buffer having a lower end and said retention mechanism, wherein said cartridge further includes an upper end, and said upper end of said cartridge is received in said lower end of said buffer.

2. The automated freezer as recited in claim 1 further including a removal device and an exit opening, and said removal device removes at least one of said items from said automated freezer through said exit opening in response to said request.

3. The automated freezer as recited in claim 2 wherein said platform raises after at least one of said items exits said automated freezer through said exit opening.

4. The automated freezer as recited in claim 2 further including a sensor, and said removal device removes at least one of said items from said automated freezer through said exit opening in response to said request when said sensor detects at least one of said items.

5. The automated freezer as recited in claim 2 wherein said removal device is pivotal.

6. The automated freezer as recited in claim 1 further including a controller associated with the automated freezer and a POS device, and wherein said request comprises a signal sent by said POS device.

7. The automated freezer as recited in claim 1 wherein said cartridge has a substantially circular inner profile.

8. The automated freezer as recited in claim 1 wherein said cartridge includes a first portion and a second portion, and said first portion is removably attached to said second portion by an attachment feature, and said first portion includes a first bottom end having a first half-circular cutout and said second portion includes a second bottom end having a second half-circular cutout, said first half-circular cutout and said second half-circular cutout define a circular cutout when said first portion is attached to said second portion.

9. The automated freezer as recited in claim 8 wherein said platform has a platform diameter and said circular cutout has a cutout diameter, and said cutout diameter is greater than said platform diameter.

10. The automated freezer as recited in claim 8 wherein said cartridge includes a bottom edge having an opening with an opening dimension, and said platform includes a platform diameter, and said opening dimension is greater than said platform diameter.

11. The automated freezer as recited in claim 1 further comprising means for transferring said at least one item from the automatic freezer to a grill for cooking said at least one item.

12. The automated freezer as recited in claim 1 further including a sensor that detects when said cartridge is empty and a visual indicator that indicates when said sensor detects that said cartridge is empty.

13. The automated freezer as recited in claim 1, wherein said at least one item is a hamburger.

14. The automated freezer as recited in claim 1, further comprising means for automatically transferring said at least one item from the automated freezer to a grill for cooking said at least one item in response to the request.

15. The automated freezer as recited in claim 1, wherein said automated freezer freezes at least one item.

16. The automated freezer as recited in claim 1 further including a resilient member that biases said plurality of arms into said first position.

17. The automated freezer as recited in claim 1 wherein said plurality of arms comprise four arms.

18. The automated freezer as recited in claim 1 wherein said first position is substantially perpendicular to said second position.

19. The automated freezer as recited in claim 1 wherein said at least one item biases said plurality of arms into said second position.

* * * * *